United States Patent [19]

Moriconi et al.

[11] 4,035,520

[45] July 12, 1977

[54] IMAGING SYSTEMS

[75] Inventors: Joseph H. Moriconi; Louis H. Burrows, Jr., both of Rochester, N.Y.

[73] Assignee: Xerox Corporation, Stamford, Conn.

[22] Filed: Apr. 18, 1975

[21] Appl. No.: 569,342

Related U.S. Application Data

[62] Division of Ser. No. 315,958, Dec. 18, 1972, Pat. No. 3,916,065.

[52] U.S. Cl. ..... 427/19; 96/1 SD; 427/14; 427/18; 427/20

[51] Int. Cl.[2] ..... G03G 13/08; G03G 9/02

[58] Field of Search ..... 427/14, 18, 20, 19; 252/62.1; 96/1 SD

[56] References Cited

UNITED STATES PATENTS

| | | | |
|---|---|---|---|
| 3,632,512 | 1/1972 | Miller | 252/62.1 |
| 3,784,501 | 1/1974 | Pettit | 260/31.6 |
| 3,811,880 | 5/1974 | Browning | 252/62.1 X |

*Primary Examiner*—Michael R. Lusignan
*Assistant Examiner*—Stuart D. Frenkel

[57] ABSTRACT

An electrostatographic imaging process comprising the steps of providing an electrostatographic imaging member having a recording surface, forming an electrostatic latent image on the recording surface, and contacting the electrostatic latent image with a developer mixture comprising finely-divided toner particles electrostatically clinging to the surface of carrier particles having an average particle diameter of between about 50 microns and about 1,000 microns. The carrier particles consist essentially of a metallic core coated with a thermoset crosslinked acrylic resin to form an adherent durable film of said resin on said core. The acrylic resin consists essentially of esters of acrylic and methacrylic acids selected from the group consisting of a hydroxyl-functional resin crosslinked with nitrogen resins, a carboxyl-containing polymer crosslinked with epoxy resins, and a carboxyl-containing polymer which has been cured with melamine-formaldehyde resins.

6 Claims, No Drawings

IMAGING SYSTEMS

This is a division of application Ser. No. 315,958, filed Dec. 18, 1972, now U.S. Pat. No. 3,916,065.

BACKGROUND OF THE INVENTION

This invention relates, in general, to electrostatographic imaging systems, and, in particular, to improved developer materials and their uses.

The formation and development of images on the surface of photoconductive materials by electronstatic means is well-known. The basic electrophotographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finely-divided electroscopic material referred to in the art as "toner". The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E. N. Wise in U.S. Pat. No. 2,618,552 is well-known as "cascade" development. In this method, a developer material comprising relatively large carrier particles having finely-divided toner particles electrostatically clinging to the surface of the carrier particles is conveyed to and rolled or cascaded across the electrostatic latent image bearing surface. The composition of the toner particles is so chosen as to have a triboelectric polarity opposite that of the carrier particles. As the mixture cascades or rolls across the image bearing surface, the toner particles are electrostatically deposited and secured to the charged portion of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier particles and unused toner particles are then recycled. The technique is extremely good for the development of line copy images. The cascade development process is the most widely used commercial electrostatographic development technique. A general purpose office copying machine incorporating this technique is described in U.S. Pat. No. 3,099,943.

Another technique for developing electrostatic latent images is the "magnetic brush" process as disclosed, for example, in U.S. Pat. No. 2,874,063. In this method, a developer material containing toner and magnetic carrier particles is carried by a magnet. The magnetic field of the magnet causes alignment of the magnetic carriers in a brush-like configuration. This magnetic brush is engaged with an electrostatic latent image bearing surface and the toner particles are drawn from the brush to the electrostatic latent image by electrostatic attraction.

Another technique for developing electrostatic latent images is the "touchdown" process as disclosed, for example, in U.S. Pat. Nos. 2,895,847 and 3,245,823 to Mayo. In this method, a developer material is carried to a latent image bearing surface by a support layer such as a web or sheet and is deposited thereon in conformity with said image.

Carrier particles are made from or coated with materials having appropriate triboelectric properties as well as certain other physical characteristics. Thus, the materials employed as the carrier particles or the coatings thereon should have a triboelectric value commensurate with the triboelectric value of the toner to enable electrostatic adhesion of the toner to the carrier particles and subsequent transfer of the toner from the carrier particles to the image on the plate without excessive power requirements. Furthermore, the triboelectric properties of all the carrier particles should be relatively uniform to permit uniform pick-up and subsequent deposition of toner. The materials employed in the carrier particles should have an intermediate hardness so as not to scratch the plate or drum surface upon which the electrostatic image is initially placed while being sufficiently hard to withstand the forces to which they are subjected during recycle. The carrier particles as well as the surface thereof also should not be comprised of materials which are so brittle as to cause either flaking of the surface or particle break-up under the forces exerted on the particles during recycle. The flaking causes undesirable effects in that the relatively small flaked particles will eventually be transferred to the copy surface thereby interfering with the deposited toner and causing imperfections in the copy image. Furthermore, flaking of the carrier particle surface will cause the resultant carrier particles to have non-uniform triboelectric properties when the carrier particle is composed of a core material different from the surface coating thereon. This results in undesirable non-uniform pick-up of toner by the carrier particles and non-uniform deposition of toner on the image. In addition, when the carrier particle size is reduced, the removal of the resultant small particles from the plate becomes increasingly difficult. Thus, the type of materials useful for making carrier particles or for coating carrier particles, although having the appropriate triboelectric properties, are limited because other physical properties which they possess may cause the undesirable results discussed above.

It is highly desirable to alter triboelectric properties of the carrier cores to accommodate the use of desirable toner compositions while retaining the other desirable physical characteristics of the carrier particle. The alteration of the triboelectric properties of carrier particles by applying a surface coating thereon is a particularly desirable technique. With this technique, not only is is possible to alter the triboelectric properties of carrier particles made from materials having desirable physical characteristics, it is also possible to employ materials previously not suitable as carrier particles. Thus, for example, carrier particles having desirable physical properties with the exception of hardness, can be coated with a material having desirable hardness as well as other physical properties, rendering the resultant product useful as carrier particles.

While ordinarily capable of producing good quality images, conventional developing materials suffer serious deficiencies in certain areas. The developing materials must flow freely to facilitate accurate metering and even distribution during the development and developer recycling phases of the electrostatographic process. Some developer materials, though possessing desirable properties such as proper triboelectric characteristics, are unsuitable because they tend to cake, bridge and agglomerate during handling and storage. Adherence of carrier particles to reusable electrostatographic imaging surfaces causes the formation of undesirable scratches on the surfaces during image transfer and surface cleaning steps. The tendency of carrier particles to adhere to imaging surfaces is aggravated when the carrier surfaces are rough and irregular. The coatings of most carrier particles deteriorate rapidly when employed in continuous processes which require the recycling of carrier particles by bucket conveyors partially submerged in the developer supply such as disclosed in U.S. Pat. No. 3,099,943. Deterioration occurs when portions of or the entire coating separates from the carrier core. The separation may be in the form of chips, flakes or entire layers and is primarily caused by fragile, poorly adhering coating materials which fail upon impact and abrasive contact with machine parts and other carrier particles. Carriers having coatings which tend to chip and otherwise separate from the carrier core must be frequently replaced thereby increasing expense and loss of productive time. Print deletion and poor print quality occur when carrier particles having damaged coatings are not replaced. Fines and grit formed from carrier disintegration tend to drift and form undesirable and damaging deposits on critical machine parts. Many carrier coatings having high compressive and tensile strength either do not adhere well to the carrier core or do not possess the desired triboelectric characteristics. The triboelectric and flow characteristics of many carriers are adversely affected when relative humidity is high. For example, the triboelectric values of some carrier coatings fluctuate with changes in relative humidity and are not desirable for employment in electrostatographic systems, particularly in automatic machines which require carriers having stable and predictable triboelectric values. Another factor affecting the stability of carrier triboelectric properties is the susceptibility of carrier coatings to "toner impaction". When carrier particles are employed in automatic machines and recycled through many cycles, the many collisions which occur between the carrier particles and other surfaces in the machine cause the toner particles carried on the surface of the carrier particles to be welded or otherwise forced into the carrier coatings. The gradual accumulation of permanently attached toner material on the surface of the carrier particles causes a change in the triboelectric value of the carrier particles and directly contributes to the degradation of copy quality by eventual destruction of the toner carrying capacity of the carrier. Thus, there is a continuing need for a better developer material for developing electrostatic latent images.

It is, therefore, an object of the this invention to provide developers which overcome the above-noted deficiencies and are suitable for use in electrostatographic reproduction processes.

It is another object of this invention to provide carrier particles which possess improved electrostatic and physical properties for efficient and prolonged use in electrostatographic reproduction processes.

It is a further object of this invention to provide carrier particles having a hard and tough coating which tenaciously adheres to the carrier core whereby the carrier particles are more resistant to toner impaction, chipping and flaking.

It is another object of this invention to provide developing materials which flow more freely.

It is yet another object of this invention to provide carrier coatings having more stable triboelectric values.

It is a further object of this invention to provide carrier coatings having higher tensile and compressive strength.

It is yet another object of this invention to provide carrier coatings having greater resistance to disintegration.

It is still another object of this invention to provide more toner impaction resistant carrier coatings.

It is another object of this invention to provide developers having physical and chemical properties superior to those of known developer materials.

The above objects and others are accomplished, generally speaking, by providing a carrier for electrostatographic developer mixtures, said carrier comprising a core coated with a thermosetting acrylic resin. The thermosetting acrylic resin electrostatographic carrier coating of this invention comprise ester of acrylic and methacrylic acids. Further, the thermosetting acrylic resin electrostatographic carrier coatings of this invention may be generally subdivided into two groups according to their mechanism of crosslinking. One of these groups is the hydroxyl-functional type of thermosetting acrylic resins which are normally crosslinked with nitrogen resins. The other group is the carboxyl type of thermosetting acrylic resins which are normally crosslinked with epoxy resins. In general, the carries of the present invention are prepared by coating a granular carrier material consisting of a core, base or substrate composed of any selected material which may be of high specific gravity such as glass or steel beads, covered with a thermosetting acrylic resin coating suitable to impart the desired electrostatographic properties to the carrier material so that it will properly charge an electroscopic powder when mixed therewith, while maintaining such a relative specific gravity as to insure against adherence of the carrier material to an electrostatographic imaging surface.

Such a carrier material may be produced by adhering an outer coating comprising a thermosetting acrylic resin to a core, base or substrate carrier material by adding a thermosetting acrylic resin that is self-curing or made curable with catalysts or co-resins to the carrier material and curing the thermosetting acrylic resin thereon. The coated core, base or substrate carrier material is then mixed with an electroscopic powder and employed in developing an electrostatic latent image.

Acrylic resins are either thermoplastic, that is, remeltable, or thermosetting. A few acrylic resins lie in between in that they are thermoplastic under certain conditions and thermosetting under other conditions. The thermosetting acrylic resins of the invention are those that solidify or set on heating or curing and cannot be remelted. The thermosetting acrylic resins of this may be prepared from acrylic acid, $CH_2$=CHCOOH, or from a derivative of acrylic acid. The acrylic monomers that may be employed to prepare these thermosetting acrylic resins are a suborder of the parent group of vinyl monomers. The vinyl grouping that is common to all these monomers is $CH_2$=C<. When an acid or carboxyl group is joined to the vinyl radical together with a hydrogen atom or methyl group, the products are acrylic and methacrylic acids. These are the starting points for all acrylic resins. Esterification of the acrylic acids with various alcohol substituents gives a large group of acrylic esters with a wide range of properties dependent upon the chain length of the alcohol used. By halogen substitution, another large group of useful acrylates is obtained. Further, nitrogen substitution also yields another useful group of acrylics which may be exemplified by acrylonitrile. The thermosetting acrylic resins of this invention may be condensation polymers formed through the reaction of their functional groups with the possible elimination of water and similar by-products. The reactivity of the starting compounds of this invention, in terms of the number of functional groups involved in the reaction, determines the type or structure of polymer formed. In order for a polymer to be formed, the reaction components should each have at least two reactive functional groups, that is, have bifunctional groups. For the preparation of the thermosetting acrylic crosslinked resin polymers of this invention, it is necessary that at least one of the reactants be trifunctional, and may be tetrafunctional to provide the three or more points of attachment to the molecule for the network structure of the thermosetting polymer. The thermosetting property of the acrylic resins of this invention thus is usually associated with a crosslinking reaction which forms a three-dimensional network of polymer molecules. It has been found that crosslinking the resins improves their craze resistance and thermal stability when they are employed as carrier coatings for electrostatographic developer materials.

Coating of the carrier materials is accomplished with thermosetting acrylic resin polymer solutions which upon curing give rise to crosslinked thermoset acrylic resins. Curing may be defined as changing the physical properties of a material by chemical reaction, usually to a harder or more permanent form, and the term is sometimes synonymous with set. During the curing cycle, complete polymerization takes place and the completely crosslinked acrylic polymer is formed thus making it thermosetting or non-fusible. The intermediate thermoplastic polymer is sometimes referred to as the "B-stage" resin, and simpler modifications of the early reaction mixture are sometimes called "A-stage" resins. The "C-stage" is usually the final stage in the reactions of a thermosetting acrylic resin, that is, a fully cured or set stage. Thermosetting acrylic resins generally cannot be reshaped once they have been fully cured and this property has been found to be extremely advantageous for electrostatographic developer materials.

Any suitable polymer of a self-curing or curable thermosetting acrylic resin may be employed as the carrier coating for the coated carriers of this invention. Typical thermosetting acrylic polymers include acrylic and methacrylic esters such as methyl acrylate, ethyl acrylate, butyl acrylate, tertbutyl acrylate, 2-ethylhexyl acrylate, neopentyl acrylate, methyl chloroacrylate, isobornyl acrylate, cyclohexyl acrylate, dodecyl acrylate, hexyldecyl acrylate, isopropyl acrylate, tetradecyl acrylate, secbutyl acrylate, methyl methacrylate, ethyl methacrylate, propyl methacrylate, isopropyl methacrylate, isobutyl methacrylate, butyl methacrylate, n-butyl methacrylate, pentyl methacrylate, hexyl methacrylate, cyclohexyl methacrylate, decyl-octyl methacrylate, lauryl methacrylate, stearyl methacrylate, 1,3-butylene dimethacrylate, 2-n-tert-butylaminoethyl methacrylate, 2-butyl methacrylate, glycidyl methacrylate, 2-chloroethyl methacrylate, 3,3-dimethylbutyl methacrylate, 2-ethylhexyl methacrylate, 2-methoxyethyl methacrylate and mixtures thereof. The polymers derived from these acrylic and methacrylic esters vary from soft, elastomeric, film-forming materials to hard resins. Many of these material are commercially available and are self-curing or made curable with catalysts or co-resins. This latter property allows for control over the desired electrostatographic properties of the coated carrier. For example, the curable thermosetting acrylic resin carrier coating materials of this invention may generally be carboxyl containing polymers which react with other resins such as epoxies and with curing agents such as hexamethoxymethylmelamine. These curable thermosetting acrylic resins exhibit hardness, adhesion and thermal properties similar to the self-curing resins. In addition, these curable thermosetting resins provide a further advantage in enabling control of the triboelectric properties of a developer composition giving them a versatility not usually found with the heat reactive resins. Further, the curable thermosetting acrylic resin carrier coating materials of this invention may be crosslinked with a wide variety of amino or epoxy resins to provide coating compositions possessing maximum electrostatographic properties. Depending on the crosslinking modifier employed, these resins may be formulated to produce carrier coatings having a good combination of flexibility and hardness, excellent chip resistance, one coat adhesion, exterior durability and good resistance to humidity.

Thus, any suitable crosslinking modifier may be employed with the curable thermosetting acrylic resin carrier coating materials of this invention. Typically, a wide variety of urea and melamine-formaldehyde resins are suitable crosslinking additives for these resins. For example, a melamine resin of the methylated methylol type usually provides the best low temperature bake performance as well as good short cycle high temperature bake properties. The butylated resins generally provide more economical, mar-resistant carrier coatings but flexibility suffers slightly. In the case of curable thermosetting acrylic resin-amino resin carrier coating compositions for low temperature curing in the range of about 180° F. to about 220° F., a small addition of an acid catalyst is desirable for optimum crosslinking. Similarly, a small amount of catalyst may be used to shorten the curing time at high temperatures. Some of the most commonly used catalysts include p-toluene sulfonic acid, phenyl and butyl phosphoric acids, and they are generally employed in amounts of about 0.3 to about 1.5 parts by weight per 100 parts by weight of total resin solids. In the case of curable thermosetting acrylic resin-melamine-formaldehyde compositions modified with epoxy resins, the addition of about 10 to about 30 parts total solids of epoxy resin, and about 15 to 25 parts total solids of melamine resin per 100 parts total solids of the acrylic resin are preferred for optimum carrier coating properties.

Any suitable vinyl monomer may be employed in the carrier coating materials of this invention. Vinyl monomers may be defined as those monomers containing the characteristic ethylenically unsaturated structure: >C=C<, and capable of undergoing addition polymerization. Typical vinyl monomers include: esters of saturated alcohols with mono and polybasic unsaturated acids such as alkyl acrylates and methacrylates, haloacrylates, diethyl maleate, and mixtures thereof; vinyl and vinylidene halides such as vinyl chloride, vinyl fluoride, vinylidene chloride, vinylidene fluoride, tetrafluoroethylene, chlorotrifluoroethylene and mixtures thereof; vinyl esters such as vinyl acetate, unsaturated aromatic compounds such as styrene and various alkyl styrenes, parachlorostyrene, parabromostyrene, 2,4, dichlorostyrene, vinyl naphthalene, paramethoxystyrene and mixtures thereof; unsaturated amides such as acrylamide, methacrylamide and mixtures thereof; unsaturated nitriles such as acrylonitrile, methacrylonitrile, haloacrylonitrile phenylacrylonitrile, vinylidene cyanide, and mixtures thereof; N-substituted unsaturated amides such as N,N-dimethyl acrylamide, N-methyl acrylamide and mixtures thereof; conjugated butadienes such as butadiene, isoprene and mixtures thereof; unsaturated ethers such as divinyl ether, diallyl ether, vinyl alkyl ether and mixtures thereof; unsaturated ketones such as divinyl ketone, vinyl alkyl ketone and mixtures thereof; unsaturated aldehydes and acetals such as acrolein and its acetals, methacrolein and its acetals, and mixtures thereof; unsaturated heterocyclic compounds such as vinyl pyridine, vinyl furan, vinyl coumarone, N-vinyl carbazole, and mixtures thereof; unsaturated alicyclic compounds such as vinylcyclopentane, vinyl-cyclohexane and mixtures thereof; unsaturated thio compounds such as vinyl thioethers; unsaturated hydrocarbons such as ethylene, propylene, coumarone, indene, terpene, polymerizable hydrocarbon fractions, isobutylene and mixtures thereof; allyl compounds such as allyl alcohol, allyl esters, diallyl phthalate, triallylcyanurate and the like. Any suitable homopolymer, copolymer or terpolymer of the above materials may be used in the carrier coating materials of this invention. Polymers of the types above include polyvinyl butyral, copolymers of methacrylic acid with methylmethacrylate, with acrylonitrile or with styrene, copolymers of vinyl acetate with maleic anhydride, copolymers of nitrostyrene with diethylmaleate, copolymers of styrene with acrylic and methacrylic acids and esters, and the like. Included in the class of acrylics are the polymethacrylates, polyacrylates and copolymers of acrylonitrile. There are many variations in this class, mainly concerned with combinations of methacrylate esters and acrylate esters, as well as acrylonitrile used in making these polymers. These esters range from methyl to stearyl with just about every possible member of the homologous series in between. Although the methyl and ethyl esters of acrylic and methacrylic acids are most prevalent, 2-ethylhexyl and n-butyl acrylates are typical of some of the other esters used in combination with methacrylate esters to achieve the properties desired in the copolymers. These acrylic monomers are supplied in the form of clear, water-white liquids and can be mixed together in varying proportions and polymerized to a hard, clear, transparent solid by the addition of catalysts such as acid, ether peroxides, or diazo compounds, and heat. Because of the possibility that slight traces of contaminants, including air and ultraviolet light, may initiate polymerization and cause a spontaneous explosion, an inhibitor such as hydroquinone is usually added to the monomers for safe storage and shipping.

The carrier coating thermosetting acrylic resin materials of this invention are made by polymerization of acrylic and methacrylic derivatives, chiefly from the esters of acrylic acid and methacrylic acids, ethyl acrylate and methyl acrylate. The resins may be polymerized by conventional bulk, suspension, solvent, and emulsion techniques. Depending upon the constitution of the monomers, the method and conditions of polymerization, the resins may range from soft, sticky semi-solids to hard, tough solids. They may also be copolymerized with a large number of other monomers to contribute to internal plasticization, increased polymerization rate, greater toughness, improved compatibility with other resins, better adhesion to substrate, and better resistance to heat, light, and weathering. For example, dimethylaminoethyl methacrylate and t-butylaminoethyl methacrylate provide means for introducing into copolymers pendant amino groups which can promote adhesion to many substrate and provide anchoring sites for dyes and pigments. The amino groups can also serve as reactive sites for secondary crosslinking. Hydroxyethyl methacrylate and hydroxypropyl methacrylate permit the introduction of reactive hydroxyl groups into copolymers and thus possibilities for subsequent crosslinking and for increased adhesion to certain substrate, particularly for thermosetting coatings. Allyl methacrylate may be employed as a crosslinking agent for other resins to raise their softening point and increase their hardness. Generally, emulsion and solution techniques are used to yield polymers in forms convenient for coatings. Thus, depending on the monomers selected and the method of polymerization, acrylic polymers having a wide range of physical properties may be obtained. However, all the acrylics have an unusual degree of resistance to the effects of long exposures to sunlight, heat and weathering. In this respect, they are much superior to related materials such as styrene, vinyl chloride and vinyl acetate.

Under various conditions of polymerization the end product may have a low or high molecular weight. In general, the lower the molecular weight the softer the material and the higher the molecular weight the tougher the material. Usually, the physical nature of the polymer depends on the monomer or combination of monomers used. In general, the lower acrylic esters are softer materials such as 2-ethyl-hexyl acrylate and n-butyl acrylate and range to the tough but flexible methyl acrylate. The methacrylic esters are somewhat harder.

When the polymer formed consists of a straight chain of molecules it is usually thermoplastic. However, the addition of varying amounts of crosslinking agents during polymerization that will form random bridges from chain to chain causes the polymer to become less thermoplastic and more thermosetting. Crosslinking agents are di-functional materials such as dimethacrylates and diallylic compounds and the like. Partially crosslinked polymers are generally used to improve heat resistance.

Acrylics are well-known and some of the better known commercial acrylic resins are solution polymers in an organic solvent available from Rohm & Haas Company, Philadelphia, Penna. under the name of "Acryloid". Acrylics are also available from Union Carbide Corporation under the name of "Acrylic Resin". The Acryloid resins of Rohm & Haas are acrylic copolymer solid resins and the Acryloid resins of Rohm & Haas are acrylic copolymer solid resins and the "Acrysol" resins are solutions for coatings. Acryloid A-10, used for coatings and finishes, is a solution of styrene-acrylic in cellosolve acetate, and acryloid B-7 is a solution in ethylene dichloride. The best all-around resin properties are usually obtained from copolymers rather than the homopolymers. Although most of the compositions of the Acryloid resins are not given in the literature, it may be safe to assume that many of them are copolymers of the various acrylic and methacrylic esters.

One of the important features that makes acrylic polymers desirable as coating materials is that generally no plasticizer is needed to produce a soft film. Acrylics are referred to as being internally plasticized by use, in deisrable proportion, of the normally soft monomers in their preparation. Plasticizer is efficient as a softening agent, but tends to migrate to the surface, giving the plastic a greasy feel, and eventually loss of plasticizer in coatings causes embrittlement that leads to failure. Internally plasticized acrylics will retain their softness indefinitely. Although homopolymers are used in some cases, most acrylics are copolymers of 2, 3, or 4 monomers. Most vinyls and their sub-order, acrylics, are classified as thermoplastic materials that can be repeatedly softened by heating. However, heat softening is often a feature that is undesirable in the final application as in electrostatographic development processes. Therefore, the thermosetting property of acrylics is highly desirable in electrostatography.

The polymerizable monomers employed to form the carrier coating materials of this invention may be mixed with any suitable free-radical initiator or catalyst capable of polymerizing the monomers or prepolymers. By a "free-radical initiator or catalyst" is meant a compound which is capable of producing free-radicals under the polymerization conditions employed, such as compounds having and —O—O— or an —N=N— linkage. Examples of the more commonly employed free radical initiators or catalysts include: alkyl peroxides, such as tert-butyl hydroperoxide, and di-tert-butyl peroxide; acyl and aroyl peroxides, such as dibenzoyl peroxide, perbenzoic acid, dilauroyl peroxide, perlauric acid, and acetyl benzoyl peroxide, azo compounds, such as azo-bis-isobutyronitrile, dimethylazo-diisobutyrate, azo-bis-1-phenylethane and alkali metal azodisulfonates; and the like. In general, the free radical initiators or catalysts are employed in an amount from about 0.0001 to about 5.0 percent based on the combined weight of the polymerizable ingredients.

The polymerization temperature to be employed is generally dependent on the batch size, the amount of initiator or catalyst present, the molecular weight to be attained, and the activation energy of the polymerization reaction. The rate of polymerization increases with an increase in temperature. Because greater exothermic reactions occur at high temperatures and increase the danger of uncontrollable reactions, high temperatures are preferably employed where the heat of polymerization may be removed under controlled conditions, e.g., in jacketed tubes through which the polymerizable or partially polymerized material is continuously passed, or in stirred kettles. The polymerization reaction is conducted at a temperature that is at or above the activation temperature of the particular free radical catalyst employed but below the boiling points of the monomers present at the pressures used. The polymerization temperature employed is usually within the range of about 60° C. to about the reflux temperatures of the monomer mixture at atmospheric pressure. Reaction times ranging from about 6 to about 48 or more hours are usually employed at atmospheric pressure in batch type operations. However, economy and operating conditions such as the use of pressure or a vacuum may determine the use of higher or lower temperatures. Polymerization may be effectuated by suitable methods such as by bulk or solvent polymerization techniques. If a solvent is employed, it can be any suitable true organic solvent, i.e., a liquid unreactive to the system but capable of dissolving the reactive components. Typical well-known solvents include the chlorinated, ketone, ester and hydrocarbon solvents such as for example, xylene, benzene, toluene, hexane, cyclopentane, 1,1,1-trichloroethylene, ethyl acetate, methyl ethyl ketone, dioxane, 1,1,2-trichloroethane and the like.

The degree of polymerization may be determined by periodic molecular weight tests of samples taken from the reaction mixture. When the weight-average molecular weight of the polymer is sufficient, as controlled, by the reaction conditions including time, temperature, catalyst and type of monomer, the polymer may, if necessary, be dissolved in any suitable solvent and applied to carrier substrates by conventional coating methods, e.g., spraying, dipping, or fluidized bed coating. Typical solvents for the polymers include the solvents described immediately above.

Any suitable coating thickness may be employed. However, a coating having a thickness at least sufficient to form a thin continuous film is preferred because the carrier coating will then possess sufficient thickness to resist abrasion and prevent pinholes which adversely affect the triboelectric properties of the coated carrier particles. If a partially polymerized linear or crosslinked prepolymer is to be used as the coating material, polymerization is completed in situ on the surface of the carrier by further application of heat. To achieve further variation in the properties of the final resinous product, well-known non-reactive additives such as plasticizers, resins, dyes, pigments, wetting agents and mixtures thereof may be mixed with the resin.

Any suitable well-known coated or uncoated carrier material may be employed as the substrate of the carriers of this invention. Typical carrier core materials include sodium chloride, ammonium chloride, aluminum potassium chloride, Rochelle salt, sodium nitrate, potassium chlorate, granular zircon, granular silicon, methyl methacrylate, glass, silicon dioxide, flintshot, iron, steel, ferrite, nickel carborundum and mixtures thereof. Typical carrier substrates for "touchdown" donor surfaces include cloth, metal-backed paper, cellophane, aluminum foil, resins such as polyethylene terephthalate and polyvinyl resins, cellulosic derivatives, protein materials, and combinations thereof. Many of the foregoing and other typical carrier materials are described by L. E. Walkup in U.S. Pat. No. 2,618,551; L. E. Walkup et al. in U.S. Pat. No. 2,638,416; E. N. Wise in U.S. Pat. No. 2,618,552; and C. R. Mayo in U.S. Pat. Nos. 2,805,847 and 3,245,823. An ultimate coated carrier particle having an average diameter between about 50 microns to about 1,000 microns is preferred in cascade systems because the carrier particle then possesses sufficient density and inertia to avoid adherence to the electrostatic images during the cascade development process. Adherence of carrier beads to an electrostatographic drum is undesirable because of the formation of deep scratches on the drum surface during the image transfer and drum cleaning steps, particularly where cleaning is accomplished by a web cleaner such as the web disclosed by W. P. Graff, Jr. et al., in U.S. Pat. No. 3,186,838.

Any suitable finely-divided toner material may be employed with the coated carriers of this invention. Typical toner materials include gum copal, gum sandarac, rosin, cumaroneindene resin, asphaltum, gilsonite, phenolformaldehyde reins, rosin modified phenolformaldehyde resins, methacrylic resins, polystyrene resins, epoxy resins, polyethylene resins and mixtures thereof. The particular toner material to be employed obviously depends upon the separation of the toner particles from the coated carrier beads in the triboelectric series. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. Re. No. 25,136 to Carlson and U.S. Pat. No. 2,788,288 to Rheinfrank et al. These toners generally have an average particle diameter between about 1 and about 30 microns.

Any suitable pigment or dye may be employed as the colorant for the toner particles. Toner colorants are well known and include, for example, carbon black, nigrosine dye, aniline blue, Calco Oil Blue, chrome yellow, ultra marine blue, Quinoline Yellow, methylene blue chloride, Monastral Blue, Malachite Green Oxalate, lampblack, Rose Bengal, Monastral Red, Sudan Black BN, and mixtures thereof. The pigment or dye should be present in the toner in a sufficient quantity to render it highly colored so that it will form a clearly visible image on a recording member.

Any suitable conventional toner concentration may be employed with the coated carriers of this invention. Typical toner concentrations include about 1 part toner with about 10 to 200 parts by weight of carrier.

Any suitable well-known electrophotosensitive material may be employed as the photoreceptor with the coated carriers of this invention. Well-known photoconductive materials include vitreous selenium, organic or inorganic photoconductors embedded in a non-photoconductive matrix, organic or inorganic photoconductors embedded in a photoconductive matrix, or the like. Representation patents in which photoconductive materials are disclosed include U.S. Pat. No. 2,803,542 to Ullrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin.

The surprisingly better results obtained with the thermosetting acrylic resin coating materials of this invention may be due to many factors. For example, the marked durability of the coating material may be due to the fact that these resins provide improved abrasion resistance with the substrates tested. Greatly improved adhesion over conventional coating materials is obtained when the thermosetting acrylic resin coating materials of this invention are applied to glass, steel or similar metallic particles. Coatings prepared from the polymers of this invention possess smooth outer surfaces which are highly resistant to cracking, chipping, and flaking. The smooth tough surface enhances the rolling action of the carrier particles across the electrostatographic surfaces and reduces the tendency of the carrier particles to adhere to the electrostatographic surfaces. When these thermosetting acrylic resin polymers are employed in coatings for electrostatographic carriers, carrier life is unexpectedly extended particularly with respect to carrier coating durability. Additionally, the hydrophobic properties of the resins of this invention appear to contribute in some unknown manner to the stability of the triboelectric properties of the coated carrier over a range of relative humidity values. The carrier coatings are easily prepared and exhibit improved stability during extended periods of storage. Control of molecular weight of the coating materials is better resulting in improved desirable carrier coating properties. The carrier coatings employed in the present invention are non-tacky and have sufficient hardness at normal operating temperatures to prevent impaction; form strong adhesive coatings which do not flake under normal operating conditions; have triboelectric values such that they can be used with a wide variety of presently available toners in present electrostatographic processes and are hydrophobic so that they retain a constant triboelectric value. Thus, the coated carrier particles of this invention have desirable properties which permit their wide use in presently available electrostatographic processes.

The thermosetting acrylic resin carrier coating materials of this invention are further characterized by high impact strength, good resistance to weathering and to most chemicals, and good formability. When used as electrostatographic carrier coatings, these acrylic resins provide coatings having excellent durability when employed in continuous electrostatographic development processes which require the recycling of carrier particles by bucket conveyors partially submerged in the developer material supply. In addition, when these acrylic resins are applied to a carrier material from a solvent system, they are easily applied and dry quickly. Further, these acrylic resins have good heat and chemical resistance which is desirable when employed as carrier coatings in the presence of various conventional electroscopic toner materials and at the conditions encountered in electrostatographic machines.

The following examples further define, describe and compare preferred methods of preparing the coated carriers of the present invention and of utilizing them in electrostatographic applications. Parts and percentages are by weight unless otherwise indicated.

EXAMPLE I

About 10 pounds of 600 micron glass beads having a density of about 2.5 were Placed in a Vibratub (available from Vibraslide, Inc., Binghamton, N.Y.) and heated to about 80° C. with agitation. The Vibratub is stopped and a coating solution of about 454.8 grams of about a 10.0 percent by weight solution of Acryloid AT-50 (available from Rohm & Haas, Philadelphia, Pa.) containing about 1.8 grams of DuPont Oil Red Dye is added to the Vibratub. The coating solution and the heated beads were mixed for about 2 hours during which time the temperature was increased to about 182° C. and the coating dried and cured on the glass beads.

EXAMPLE II

About 10 pounds of 600 micron glass beads having a density of about 2.5 were placed in a Vibratub (available from Vibraslide, Inc., Binghamton, N.Y.) and heated to about 80° C. with agitation. The Vibratub is stopped and a coating solution of about 454.8 grams of about a 10.0 percent by weight solution of Acrylic Resin 100 (available from Union Carbide Corporation, New York, N.Y.) containing about 1.8 grams of Du-Pont Oil Red Dye is added to the Vibratub. The coating solution and the heated beads were mixed for about 2 hours during which time the temperature was increased to about 180° C. and the coating dried and cured on the glass beads.

EXAMPLE III

About 10 pounds of 100 micron steel carrier cores were placed in a Vibratub (available from Vibraslide, Inc., Binghamton, N.Y.) at room temperature of about 72° F. A coating solution of about 36.3 grams of about a 50.0 percent by weight solids solution of Acryloid AT-50 (availablefrom Rohm & Haas, Philadelphia, Pa.) and about 145.2 grams of acetone is added to the Vibratub. The Vibratub is started and the coated carrier cores are heated to dryness. The temperature is increased to about 300 ° F. and maintained for about one-half hour to promote crosslinking of the coating.

EXAMPLE IV

About 10 pounds of 250 micron steel carrier cores were placed in a Vibratub (available from Vibraslide, Inc., Binghamton, N.Y.) at room temperature of about 70° F. A coating solution of about 30.5 grams of about a 60.0 percent by weight solids solution of Acrylic Resin 100 (available from (available from Union Carbide Corporation, New York, N.Y.) and about 161.3 grams of acetone is added to the Vibratub. The Vibratub is started and the coated carrier cores are heated to dryness. The temperature is increased to about 180° C. and maintained for about one-half hour to cure the coating.

EXAMPLE V

About 5 pounds of 600 micron glass beads having a density of about 2.5 were placed in a Vibratub (available from Vibraslide, Inc. Binghamton, N.Y.) at room temperature of about 74° F. A coating solution of about 45.4 grams of about a 50.0 percent by weight solids solution of Acryloid AT-70 (available from Rohm & Haas, Philadelphia, Pa.), about 3.4 grams of hexamethoxymethylmelamine, and about 182.0 grams of xylene is added to the Vibratub. The Vibratub is started and the glass beads with the coating solution are heated to about 180° C. for about 1 hour to cure the coating.

EXAMPLE VI

About 5 pounds of 250 micron steel carrier cores were placed in a Vibratub (available from Vibraslide, Inc., Binghamton, N.Y.) at room temperature of about 73° F. A coating solution of about 11.3 grams of about a 50.0 percent by weight solids solution of Acryloid AT-70 (available from Rohm & Haas Philadelphia, Pa.), about 11.3 grams of Bisphenol A epoxy resin (Epon 1001, available from Shell Chemical Company, New York, N.Y.), and about 182.0 grams of a solvent mixture comprising about 137.0 grams of toluene and about 45.0 grams of cellosolve acetate is added to the Vibratub. The Vibratub is started and the steel cores with the coating solution are heated to about 180° C. for about 0.5 hour to cure the coating.

EXAMPLE VII

About 5 pounds of 600 micron glass beads having a density of about 2.5 were placed in a Vibratub (available from Vibraslide, Inc., Binghamton, N.Y.) at room temperature of about 71° F. A coating solution of about 45.4 grams of about a 60.0 percent by weight solids solution of Acrylic Resin 120 (available from Union Carbide Corporation, New York, N.Y.), about 3.4 grams of hexamethoxymethylmelamine, and about 182.0 grams of xylene is added to the Vibratub. The Vibratub is started and the glass beads with the coating solution are heated to about 180° C. for about 1.5 hours to cure the coatings.

EXAMPLE VIII

About 5 pounds of 250 micron steel carrier cores were placed in a Vibratub (available from Vibraslide, Inc., Binghamton, N.Y.) at room temperature of about 72° F. A coating solution of about 11.4 grams of about a 60.0 percent by weight solids solution of Acrylic Resin 120 (available from Union Carbide Corporation, New, York, N.Y.), about 9.2 grams of Bisphenol A epoxy resin (Epon 1001, available from Shell Chemical Company, New York, N.Y.), and about 182.0 grams of a solvent mixture comprising about 137.0 grams of toluene and about 45.0 grams of cellosolve acetate is added to the Vibratub. The Vibratub is started and the steel cores with the coating solution are heated to about 180° C. for about 0.5 hour to cure the coating.

In the following Examples, IX through XVI, the relative triboelectric values generated by contact of carrier beads with toner particles is measured by means of a Faraday Cage. The device comprises a brass cylinder having a diameter of about 1 inch and a length of about 1 inch. A 100-mesh screen is positioned at each end of the cylinder. The cylinder is weighed, charged with about a 0.5 gram mixture of carrier and toner particles and connected to ground through a capacitor and an electrometer connected in parallel. Dry compressed air is then blown through the brass cylinder to drive all the toner from the carrier. The charge on the capacitor is then read on the electrometer. Next, the chamber is reweighed to determine the weight loss. The resulting data is used to calculate the toner concentration and the charge in micro-coulombs per gram of toner. Since the triboelectric measurements are relative, the measurements should, for comparative purposes, be conducted under substantially identical conditions. Thus, a toner comprising a styrene-n-butyl methacrylate copolymer and carbon black as disclosed by M. A. Insalaco in U.S. Pat. No. 3,079,342 is used as a contact triboelectrification standard. Obviously, other suitable toners such as those listed above may be substituted for the toner used in the Examples.

EXAMPLE IX

A developer sample is produced by mixing about one part colored styrene-n-butyl methacrylate copolymer toner particles with about 99 parts of the coated carrier particles of Example I. The relative triboelectric value of the carrier measured by means of a Faraday Cage is about 21 micro-coulombs per gram of toner. In machine life tests employing cascade development of a positively charged reusable imaging surface and developing charged image areas, the developer performs well and print quality is good throughout the test. Substantially no toner impaction or carrier abrasion is observed.

EXAMPLE X

A developer sample is produced by mixing about one part colored styrene-n-butyl methacrylate copolymer toner particles with about 99 parts of the coated carrier particles of Example II. The relative triboelectric value of the carrier measured by means of a Faraday Cage is about 28 micro-coulombs per gram of toner. In machine life tests as in Example IX, the developer performs well and print quality is good throughout the test. Substantially no toner impaction or carrier abrasion is observed.

EXAMPLE XI

A developer sample is produced by mixing about one part colored styrene-n-butyl methacrylate copolymer toner particles with about 99 parts of the coated carrier particles of Example III. The relative triboelectric value of the carrier measured by means of a Faraday Cage is about 24 micro-coulombs per gram of toner. In machine life tests employing magnetic brush development, the developer performs well and print quality is good throughout the test. Substantially no toner impaction or carrier abrasion is observed.

EXAMPLE XII

A developer sample is produced by mixing about one part colored styrene-n-butyl methacrylate copolymer toner particles with about 99 parts of the coated carrier particles of Example IV. The relative triboelectric value of the carrier measured by means of a Faraday Cage is about 20 micro-coulombs per gram of toner. In machine life tests as in Example XI, the developer performs well and print quality is good throughout the test. Substantially no toner impaction or carrier abrasion is observed.

EXAMPLE XIII

A developer sample is produced by mixing about one part colored styrene-n-butyl methacrylate copolymer toner particles with about 99 parts of the coated carrier particles of Example V. The relative triboelectric value of the carrier measured by means of a Faraday Cage is about 25 micro-coulombs per gram of toner. In machine life tests as in Example IX, the developer performs well and print quality is good throughout the test. Substantially no toner impaction or carrier abrasion is observed.

EXAMPLE XIV

A developer sample is produced by mixing about one part colored styrene-n-butyl methacrylate copolymer toner particles with about 99 parts of the coated carrier particles of Example VI. The relative triboelectric value of the carrier measured by means of a Faraday Cage is about 32 micro-coulombs per gram of toner. In machine life tests as in Example XI, the developer performs well and print quality is good throughout the test. Substantially no toner impaction or carrier abrasion is observed.

EXAMPLE XV

A developer sample is produced by mixing about one part colored styrene-n-butyl methacrylate copolymer toner particles with about 99 parts of the coated carrier particles of Example VII. The relative triboelectric value of the carrier measured by means of a Faraday Cage is about 22 micro-coulombs per gram of toner. In machine life tests as in Example IX, the developer performs well and print quality is good throughout the tests. Substantially no toner impaction or carrier abrasion is observed.

EXAMPLE XVI

A developer sample is produced by mixing about one part colored styrene-n-butyl methacrylate copolymer toner particles with about 99 parts of the coated carrier particles of Example VIII. The relative triboelectric value of the carrier measured by means of a Faraday Cage is about 29 micro-coulombs per gram of toner. In machine life tests as in Example XI, the developer performs well and print quality is good throughout the test. Substantially no toner impaction or carrier abrasion is observed.

Although specific materials and conditions were set forth in the above examples for making and using the developer materials of this invention, these are merely intended as illustration of the present invention. Various other toners, carrier cores, substituents and processes such as those listed above may be substituted for those in the examples with similar results.

Other modifications of the present invention will occur to those skilled in the art upon a reading of the present disclosure. These are intended to be included within the scope of this invention.

What is claimed is:

1. An electrostatographic imaging process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of carrier particles having an average particle diameter of between about 50 microns and about 1,000 microns, said carrier particles consisting essentially of a metallic core coated with a thermoset crosslinked acrylic resin to form an adherent durable film of said resin on said core, said acrylic resin consisting essentially of esters of acrylic and methacrylic acids selected from the group consisting of a hydroxyl-functional resin crosslinked with nitrogen resins, a carboxyl-containing polymer crosslinked with epoxy resins, and a carboxyl-containing polymer which has been cured with melamine-formaldehyde resins, whereby at least a portion of said finely-divided toner particles are attracted to and deposited on said recording surface in conformance with said electrostatic latent image.

2. An electrostatographic imaging process according to claim 1 wherein said carboxyl-containing polymer cured with melamine-formaldehyde resins has been modified with from about 10 to about 30 parts of epoxy resins per 100 parts of said acrylic resin.

3. An electrostatographic imaging process according to claim 1 wherein said esters of acrylic and methacrylic acids are selected from the methyl to stearyl esters of said acids.

4. An electrostatographic imaging process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of carrier particles having an average particle diameter of between about 50 microns and about 1,000 microns, said carrier particles consisting essentially of a metallic core coated with a thermoset crosslinked acrylic resin to form an adherent durable film of said resin on said core, said acrylic resin consisting essentially of esters of acrylic and methacrylic acids selected from the group consisting of a hydroxyl-functional resin crosslinked with nitrogen resins, whereby at least a portion of said finely-divided toner particles are attracted to and deposited on said recording surface in conformance with said electrostatic latent image.

5. An electrostatographic imaging process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of carrier particles having an average particle diameter of between about 50 microns and about 1,000 microns, said carrier particles consisting essentially of a metallic core coated with a thermoset crosslinked acrylic resin to form an adherent durable film of said resin on said core, said acrylic resin consisting essentially of esters of acrylic and methacrylic acids selected from the group consisting of a carboxyl-containing polymer crosslinked with epoxy resins, whereby at least a portion of said finely-divided toner particles are attracted to and deposited on said recording surface in conformance with said electrostatic latent image.

6. An electrostatographic imaging process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of carrier particles having an average particle diameter of between about 50 microns and about 1,000 microns, said carrier particles consisting essentially of a metallic core coated with a thermoset crosslinked acrylic resin to form an adherent durable film of said resin on said core, said acrylic resin consisting essentially of esters of acrylic and methacrylic acids selected from the group consisting of a carboxyl-containing polymer which has been cured with melamine-formaldehyde resins, whereby at least a portion of said finely-divided toner particles are attracted to and deposited on said recording surface in conformance with said electrostatic latent image.

* * * * *